US010655404B2

(12) United States Patent
Palmer

(10) Patent No.: US 10,655,404 B2
(45) Date of Patent: May 19, 2020

(54) CARRIER FOR CONNECTING A TOOL TO A TUBULAR MEMBER

(71) Applicant: Tejas Tubular Products, Inc., Houston, TX (US)

(72) Inventor: Larry Palmer, Houston, TX (US)

(73) Assignee: Tejas Tubular Products, Inc., Houston, TX (US)

( * ) Notice: Subject to any disclaimer, the term of this patent is extended or adjusted under 35 U.S.C. 154(b) by 148 days.

(21) Appl. No.: 15/080,053

(22) Filed: Mar. 24, 2016

(65) Prior Publication Data

US 2017/0275956 A1 Sep. 28, 2017

(51) Int. Cl.
*E21B 17/10* (2006.01)

(52) U.S. Cl.
CPC ..... *E21B 17/1078* (2013.01); *E21B 17/1085* (2013.01)

(58) Field of Classification Search
CPC .. E21B 17/1078; E21B 17/1085; E21B 17/10; E21B 17/043; E21B 17/02; E21B 17/006
See application file for complete search history.

(56) References Cited

U.S. PATENT DOCUMENTS

| | | | | | |
|---|---|---|---|---|---|
| 2,126,405 | A * | 8/1938 | Miller | E21B 17/1085 | 175/325.6 |
| 2,207,005 | A * | 7/1940 | Haas | E21B 17/042 | 285/334 |
| 3,933,395 | A * | 1/1976 | Evans | E21B 17/1078 | 175/325.2 |
| 4,146,060 | A | 3/1979 | Garrett | | |
| 4,537,429 | A * | 8/1985 | Landriault | E21B 17/0423 | 285/334 |
| 4,549,613 | A * | 10/1985 | Case | E21B 10/26 | 175/325.2 |
| 7,784,838 | B2 * | 8/2010 | Levy | E21B 17/02 | 285/242 |
| 8,499,840 | B2 * | 8/2013 | Bennett | E21B 17/042 | 166/207 |
| 9,109,417 | B2 * | 8/2015 | Leiper | E21B 37/00 | |
| 2015/0021047 | A1 * | 1/2015 | Buytaert | E21B 17/1078 | 166/380 |

* cited by examiner

*Primary Examiner* — Cathleen R Hutchins
*Assistant Examiner* — Jonathan Malikasim
(74) *Attorney, Agent, or Firm* — Bushman Werner, P.C.

(57) ABSTRACT

A carrier for connecting a tool to the outside diameter of a tubular member. The carrier is a sleeve made up of first and second sleeve sections which encircle a tubular member to form a substantially complete sleeve. The sleeve is threaded on each end and there is a threaded collar received on each threaded end of the sleeve. Since the sleeve sections are formed by threading a tubular member at opposite ends, and then splitting the tubular member, when the sleeve sections are placed in surrounding relationship to the pipe, there will be at least one gap between the sleeve sections.

27 Claims, 7 Drawing Sheets

14
114
116
106
104
102
100
122
118
120
136
124
130
142
110
112
134
129
140
132
108

14
160
182

162

164
154
180
190
192
14
152
150
161
154
172
170
156

CARRIER FOR CONNECTING A TOOL TO A TUBULAR MEMBER

FIELD OF THE INVENTION

The present invention relates to downhole tools used in the drilling and production of oil and gas wells and, more particularly, to a carrier for connecting a tool to the outside of a tubular member.

BACKGROUND OF THE INVENTION

In the drilling, completion and production of oil and gas wells, different types of tubulars are employed. Thus, generally in the drilling operation drill pipe is employed, in the completion operation casing is employed, and in the production operation tubing is employed.

There are times when in all of the above described operations it is desirable and/or necessary to connect a tool into the pipe string, e.g., the drill string. For example, it is known to attach a wear belt to a drill pipe as disclosed in U.S. Pat. No. 4,146,060 to protect casing from wear by the drill pipe or to protect the drill pipe from wear by the casing or in an open hole. Still further, in many cases it is desirable that the tubular string, e.g., the drill string, have one or more centralizers connected along the length of the string.

Regardless of the nature of the tubular string, e.g., drill string, casing string, or tubing string, there can be circumstances where it would be desirable to have one or more tools connected to the outside of the tubular member, i.e. on its O.D. and which, depending upon the tool, could be replaced in the field by workers with a minimum amount of effort.

SUMMARY OF THE INVENTION

In one aspect, the present invention provides a carrier or mounting assembly for attaching to a tubular member and which can comprise or carry a tool used in a downhole operation.

In a further aspect, the present invention provides a carrier or mounting assembly which can be connected to a string of pipe used to drill an earth borehole and which can comprise and/or carry a tool used in the drilling operation.

In yet a further aspect, the present invention provides a carrier or mounting tool which can be connected to a tubular member, e.g., a section of drill pipe, wherein a tool carried or formed by or on the carrier can be replaced in the field.

These and further features and advantages of the present invention will become apparent from the following detailed description, wherein reference is made to the figures in the accompanying drawings.

DETAILED DESCRIPTION OF PREFERRED EMBODIMENTS

As used herein, "tool" or "tool assembly" refers to any surface, formation, assembly, or component(s), which when connected to the outer diameter (OD) of a tubular member, e.g., drill pipe, casing, tubing, or any other tubular member used in earth borehole operations, performs or can perform a useful action in an earth borehole and/or can or does prevent an unwanted action in an earth borehole, particularly when the tubular member is rotating and/or moving longitudinally in the earth borehole.

Figure 1:
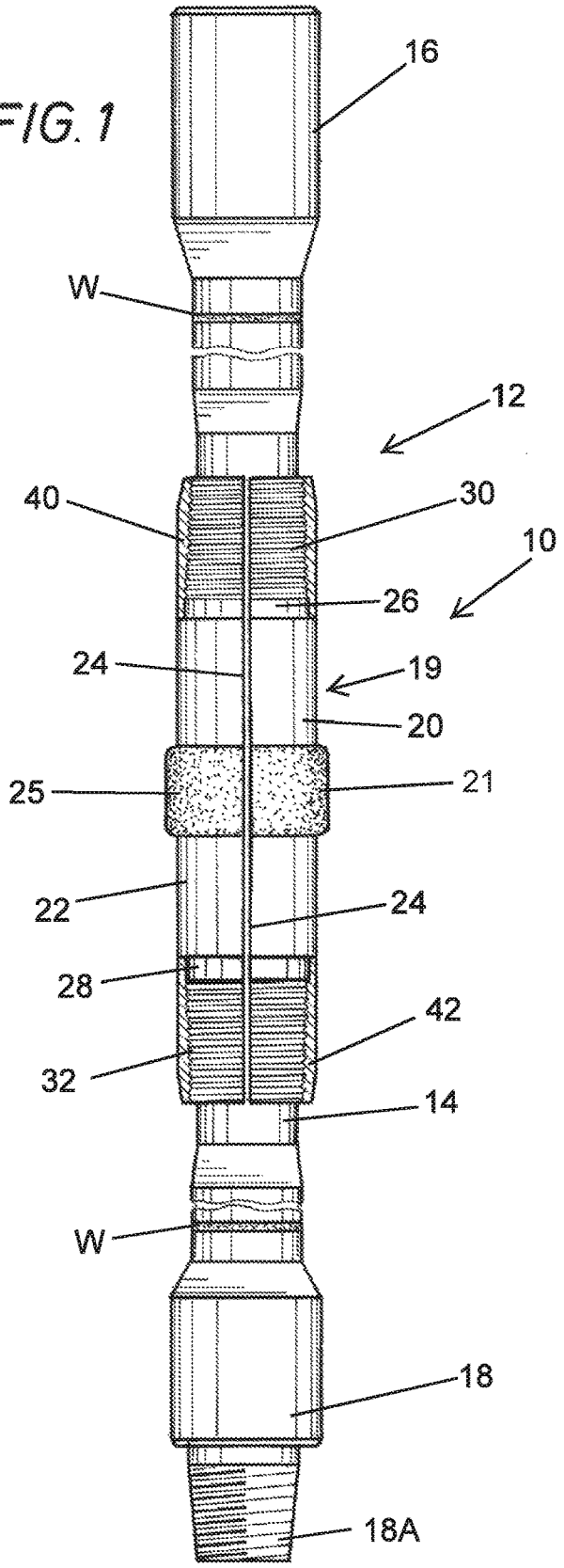
FIG. 1 is an elevational view, partly in section of one embodiment of the carrier assembly of the present invention connected to a joint of drill pipe.
Figure 2:
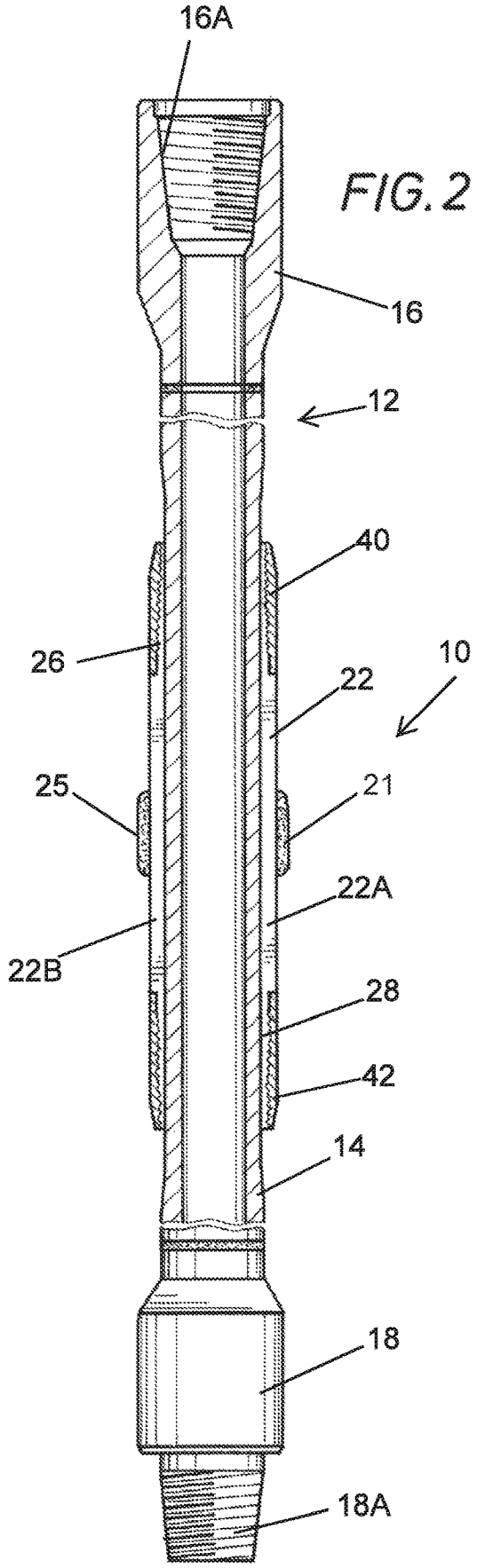
FIG. 2 shows the carrier/drill pipe assembly of FIG. 1 rotated 90° about its longitudinal axis.

Referring now to FIGS. 1 and 2, the carrier or carrier assembly of the present invention, shown generally as 10, is shown connected to the OD of a tubular member 12, which in this case is a joint of drill pipe. A drill pipe joint, as is well known to those skilled in the art, typically comprises an elongate tubular pipe section 14, a first tool joint 16 connected to one end of the pipe section 14 and a second tool joint 18 connected to the opposite end of the pipe section 14. Typically, one of the tool joints 16 is internally threaded to form a box connection while the other tool joint 18 is externally threaded to form a pin connection. Thus, as seen in FIGS. 1 and 2, tool joint 16 forms an internally threaded box connection 16A while tool joint 18 forms an externally threaded pin connection 18A. It will be understood that both tool joints 16 and 18 could form box connections or pin connections.

Carrier 10 of the present invention comprises a sleeve 19 having a first sleeve section 20 and a second sleeve section 22. Sleeve sections 20 and 22 are generally formed by splitting a section of a tubular member, e.g., a piece of pipe, lengthwise through its diameter. Accordingly, save for the lost material occasioned from the cut, e.g., via saw, laser, or any other type of cutting tool, sections 20 and 22 will be substantially semicircular. As a result of the lengthwise cut, each of the sleeve sections 20 and 22 will have two longitudinally extending, circumferentially facing surfaces formed on the wall of the substantially semicircular section. Thus with reference to FIG. 2, section 22 would have longitudinally extending surfaces 22A and 22B. In this regard, it will be appreciated that FIG. 2 shows the assembly of FIG. 1 rotated clockwise around a longitudinal axis through the pipe section 14. Thus, FIG. 2 shows the surfaces 22A and 22B formed on the wall of sleeve section 22.

It will be appreciated that in selecting a length of a tubular member to form the sleeve sections 20 and 22 of sleeve 19 the inner diameter (ID) of the selected tubular member will approximate the outer diameter (OD) of the pipe section 14. For all intents and purposes, it is preferred that the ID of the tubular member used to form the sleeve sections 20 and 22 be substantially the same as the OD of the pipe section 14.

Figure 5:
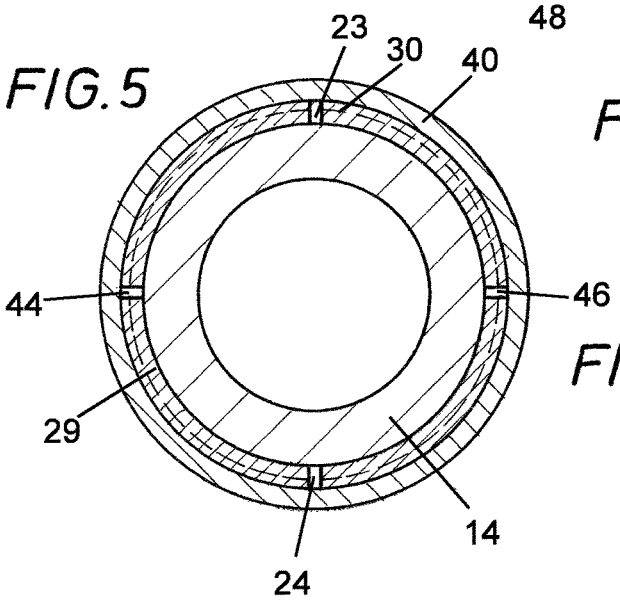
FIG. 5 is a cross-sectional view taken along the lines 5-5 of FIG. 4.

As can best be seen in FIGS. 1 and 5, when the sleeve sections 20 and 22 are positioned in surrounding relationship to the pipe section 14 to form sleeve 19 and, in the normal case, there will be two gaps such as gaps 23 and 24 which are generally of equal circumferential width. However, it will be appreciated that the gaps 23 and 24 will only be of equal width if/when the sections 20 and 22 are placed in surrounding relationship to pipe section 14, the opposed surfaces such as surfaces 22A and 22B are equally spaced from the corresponding surfaces (not shown) formed on sleeve section 20. Thus, in cases where one of the sleeves is shifted circumferentially relative to the other sleeve section, then there may be only one gap or the gaps 23 and 24 may not be of equal circumferential width. In any event, generally speaking, when the sleeve sections 20 and 22 are positioned in surrounding relationship to pipe section 14, the sum of the two gaps between sections 20 and 22 will be from about 0.020 to about 0.060 inches.

Figure 3:
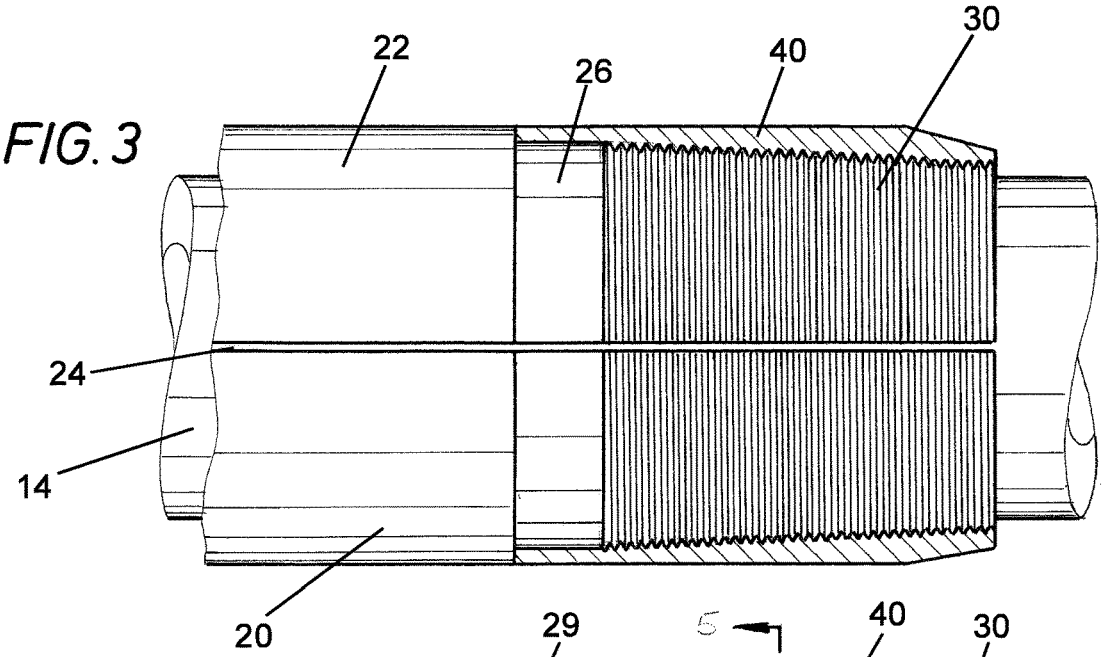
FIG. 3 is an enlarged, elevational view, partly in section, showing a portion of the carrier assembly shown in FIGS. 1 and 2.

In forming the sleeve sections 20 and 22 a desired length of a tubular member, e.g., pipe, having the desired ID and OD is selected. Opposed ends of the tubular member are then machined to form smaller diameter portions 26 and 28 at opposite ends resulting in annular, axially facing shoulders at opposite ends, shoulder 29 being shown in FIGS. 3-5. The smaller or reduced diameter portions 26 and 28 are then externally threaded to form pin connections 30 and 32, respectively. The thus machined and threaded tubular member is split to form sleeve 19 having sections 20 and 22.

Carrier assembly 10 also includes a first, internally threaded collar 40 having threads complementary to pin connection 30 and a second internally threaded collar 42 having threads complementary to pin connection 32.

In affixing carrier assembly 10 to the drill pipe joint, the desired length of the pipe section 14 would be chosen. For example, in the case of drill pipe the pipe section is approximately 31 feet long but can be of any desired length. Prior to connecting (welding) the tool joints 16 and 18 to the opposite ends of pipe section 14, sleeve sections 20 and 22 would be positioned on the OD of the pipe section 14. Collars 40 and 42 would then be received over the opposite ends of pipe section 14 and collars 40 and 42 threaded onto pin threads 30 and 32, respectively, effectively compressing sleeve sections 20 and 22 radially inwardly. It will also be apparent that the radially inward compression is accomplished without any connectors extending from either of surfaces 22A and 22B of sleeve section 22 or from the corresponding surfaces (not shown) of sleeve section 20. It should be noted that the collars 40, 42 can have right or left handed threads. For example collar 40 being at the "upper end" of the carrier 10 when the carrier 10 is in a borehole could have left hand threads to reduce the possibility of "un-torqueing" of the collar 40 during right hand rotation in a borehole. Initially, the collars 40 and 42 could be made up to the so-called hand tight position after which they could be torqued to a final made-up position, which could either be by shouldering as discussed hereafter, or simply by measurement of make-up torque. After the carrier 10 is assembled on the pipe section 14, the tool joints 16 and 19 are welded on as indicted by weld W.

As seen in FIGS. 1 and 2, the carrier 10 comprises a wear band, the wear band being comprised of first annular portion 21 on sleeve section 20 and second wear band portion 25 on sleeve section 22. Although in the embodiment shown in FIGS. 1 and 2, the wear band is comprised of two portions, i.e., portions 21 and 25, it will be appreciated that the wear band could be formed as an annular body which was slipped over the sleeve sections before the collars were placed on and then affixed to at least one of the sleeve sections in a variety of ways. A disadvantage of an annular band as opposed to a band comprised of two portions 21 and 25, is that if for example the annular band were welded to the sleeve sections 20 and 22, field disassembly would be much more difficult.

It will also be appreciated that the wear band could comprise helical strips of hard surfacing material placed on the sleeve sections 20 and 22.

It will also be appreciated that the sleeve sections 20 and 22 comprise a tool in that their outer surfaces could be treated in a particular way such that the surfaces effectively acted as hard surfacing or serve some other function. In this event, it would be preferable that the OD of the sleeve formed by sections 20 and 22 be at least equal to or greater than the tool joints 16 and 18.

Figure 4:
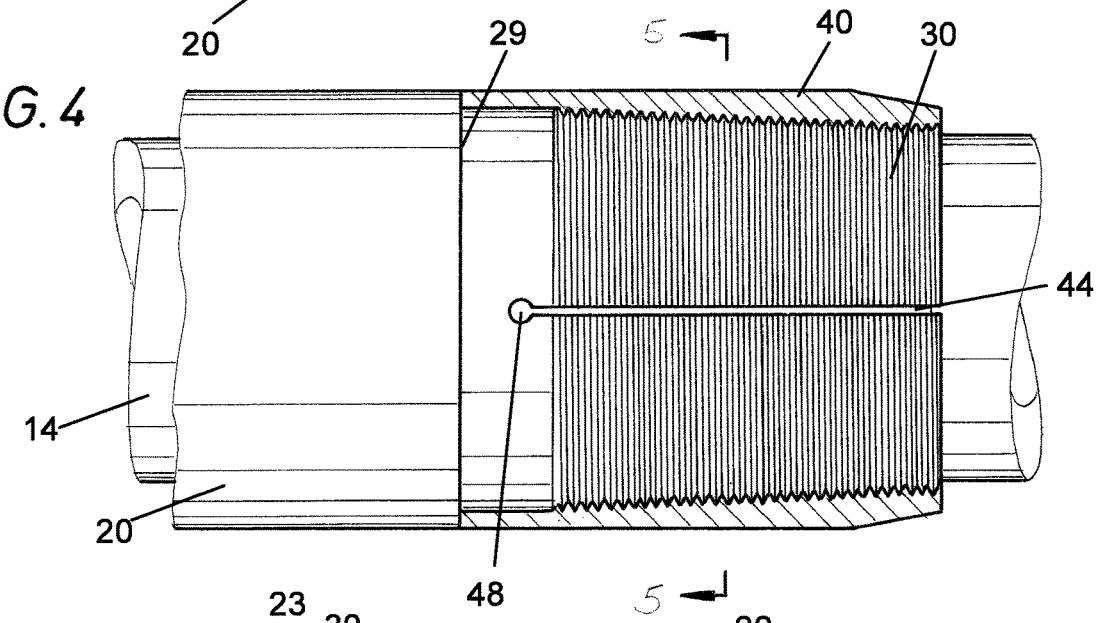
FIG. 4 is a view similar to FIG. 3 but rotated 90° about its longitudinal axis.
Figure 6:
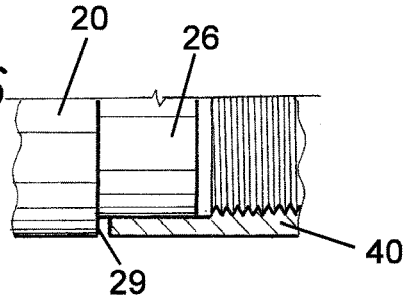
FIG. 6 is a detailed view, partly in section showing the carrier assembly prior to being fully made-up.
Figure 7:
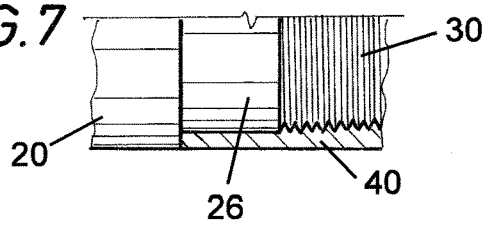
FIG. 7 is a view similar to FIG. 6, but showing the carrier assembly in the fully made-up position.

Turning now to FIGS. 4 and 5, it can be seen from FIG. 4 that in addition to the gaps 23 and 24 between the sleeve sections, the sleeve sections 20 and 22 have slits 44 and 46, respectively, which extend axially inwardly from the ends of the sleeve segments 20 and 22, respectively, the slits terminating at a stress relieving opening such as opening or hole 48 through sleeve section 20. Although not shown, it will be appreciated that a like stress relieving opening terminates slit 46. Slit 44 is generally equally, circumferentially spaced from gaps 23 and 24. Likewise, slit 46 is generally equally, circumferentially spaced from gaps 23 and 24. Generally, but optionally, the opposite ends of sleeve sections 20 and 22 also have slits similar to slits 44 and 46. In this embodiment of the present invention, i.e., when the sleeve sections 20 and 22 have slits 44 and 46, respectively, there is effectively formed a collet on the end of sleeve 19. It will be understood that the slits 44, 46 are optional but in certain cases may be preferred in terms of tightly securing sleeve 19 to tubular member 14. With reference to FIGS. 6 and 7, it can be seen that in the position in FIG. 6, collar 40 has been only partly made up, i.e., it has not been made up to a desired torque. FIG. 7 shows one condition in which the innermost end of collar 40 is an abutting relationship with shoulder 29. Accordingly, the desired amount of torque can be applied to collar 40 to ensure that collar 40 is fully made-up, i.e. is made-up to a desired torque value. It will be appreciated that in the fully made-up position as shown in FIG. 7, the collet segments can be compressed radially inwardly so as to tightly grip pipe section 14.

Although the proper amount of torque can be obtained by shouldering collar 40 and for that matter collar 42, it is to be understood that a final make-up torque can be achieved without such shouldering. Thus, if the innermost ends of the collars 40, 42 did not shoulder on sleeve 19, collars 40, 42 could still be made-up to a desired torque level employing various torque turn techniques well known to those skilled in the art.

Figure 8:
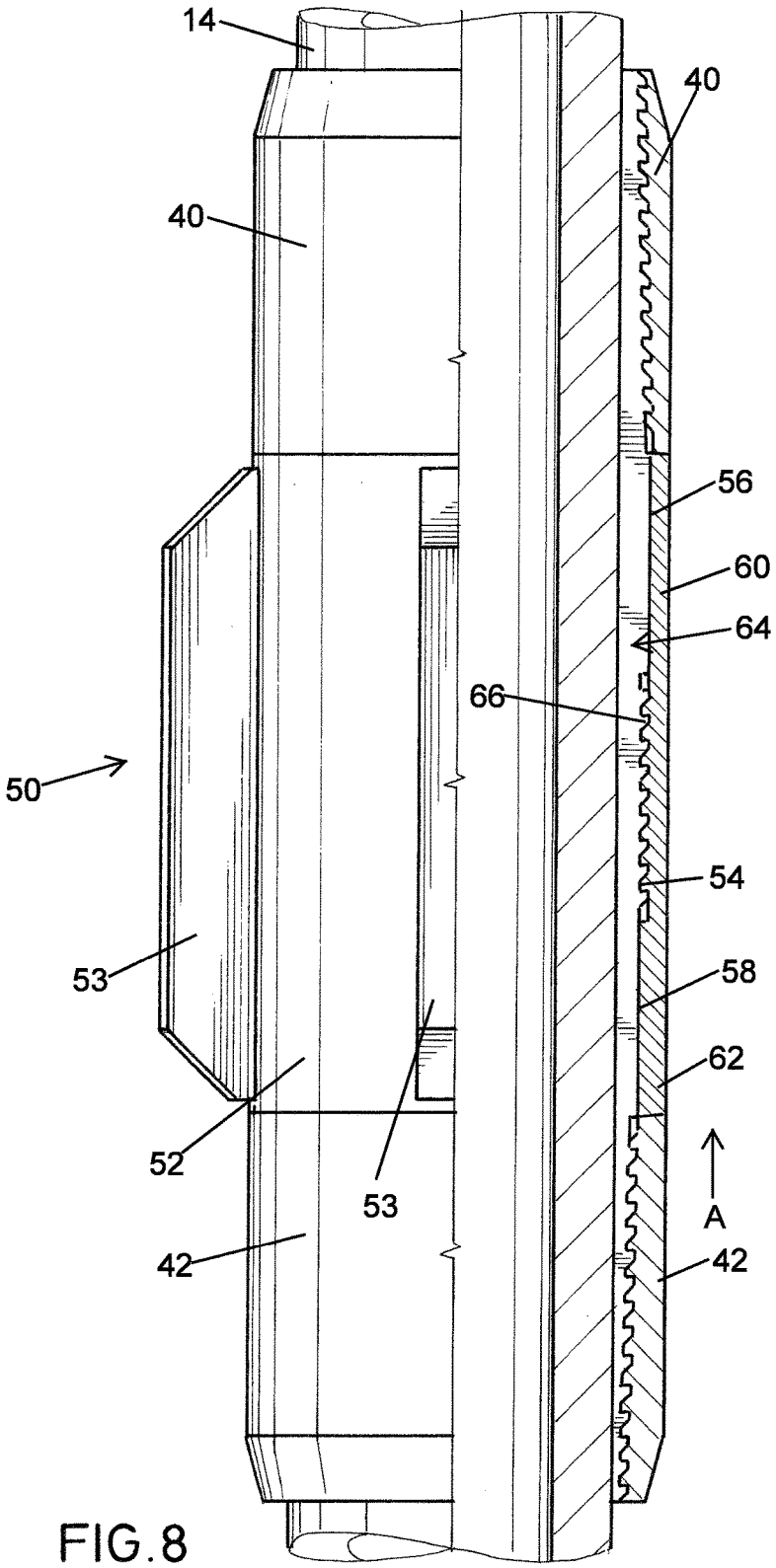
FIG. 8 is an elevational view, partly in section, showing one embodiment of the carrier assembly of the present invention carrying a centralizer.

Turning now to FIG. 8, there is shown an embodiment of the present invention wherein the tool comprises a centralizer. In the embodiment shown in FIG. 8, a centralizer, shown generally as 50 comprises an annular body portion 52 which has generally axially extending ribs 53 and generally centrally disposed internal threads 54. Threads 54 are flanked by thread-free surfaces 56 and 58 formed on wall portions 60 and 62, respectively. As seen wall portion 56 has a greater wall thickness than wall portion 58. A sleeve shown generally as 64 and comprised of first and second sleeve sections as described above with respect to the embodiments of FIGS. 1-7 is in surrounding relationship to pipe section 14. As in the case of the embodiments shown in FIGS. 1-7, there is a first collar 40 threadedly received on one threaded end of sleeve 64 and a second collar 42 threadedly received on the opposite threaded end of sleeve 64.

In assembling the embodiment shown in FIG. 8, again sleeve 64 comprised of the two sleeve sections would be placed in surrounding relationship to pipe section 14, e.g., a drill pipe, prior to the tool joints being welded on to the opposite ends of pipe section 14. With the sleeve sections forming sleeve 64 in position, the centralizer body 52 could be slid over the end of pipe section 14 in the direction of arrow A. The internal threads 54 in centralizer body 52 would then engage and be threaded onto external threads 66 formed on the OD of the sleeve 64. At this juncture, the collars 40 and 42 could then be slid over opposite ends of pipe section 14 and threaded onto the respective threaded ends of sleeve 64.

It will be recognized that while the centralizer 50 is shown as being formed as a single piece, it could in fact be split much like sleeve 64 and the split sections connected together in a suitable fashion.

Figure 12:
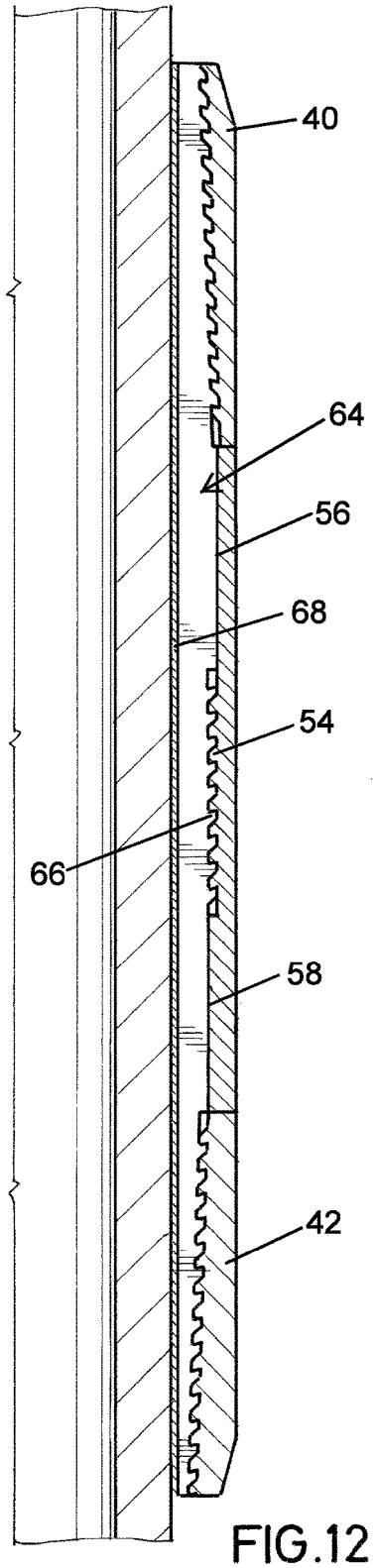
FIG. 12 is a partial, elevational view, partly in section showing another embodiment of the carrier assembly of the present invention.

Turning now to FIG. 12, there is shown a modification of the embodiment shown in FIG. 8 but which is applicable to all of the embodiments of the present invention. The embodiment of FIG. 12 differs from that shown in FIG. 8 in that in the embodiment shown in FIG. 12 there is a layer of double-sided adhesive material 68 disposed on the inner walls of the sleeve sections making up sleeve 64. It will be understood that in lieu of lining the entire inner walls of sleeve sections making up sleeve 64 with the adhesive material 68, only one of the sleeve sections could be so lined and further only a portion of one of the sleeve sections could be lined with the adhesive material. It will be appreciated that the double-sided adhesive material 68 disposed between the sleeve section and the pipe section greatly enhances the gripping between the sleeve sections and the pipe section.

Figure 9:
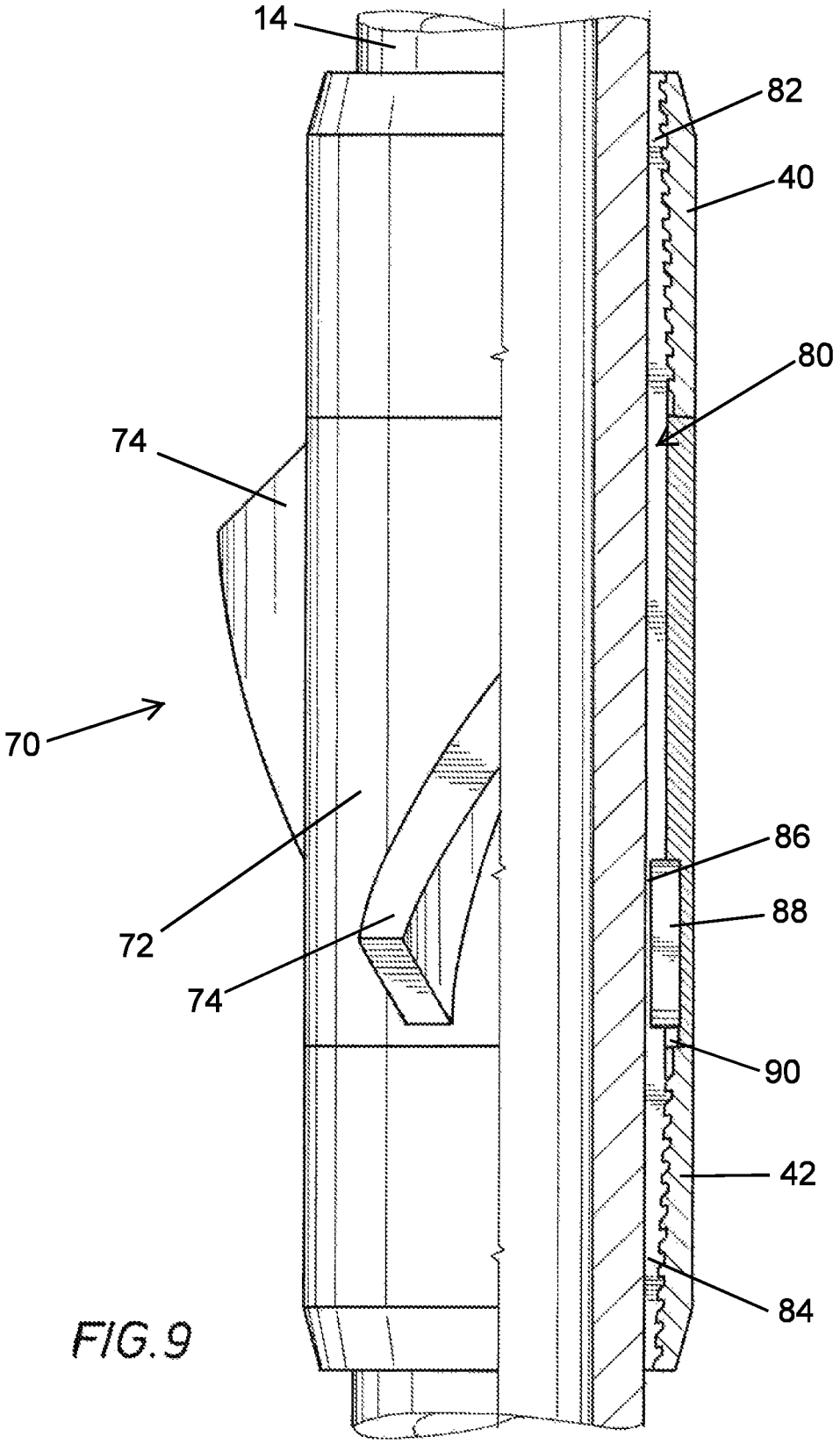
FIG. 9 is a view similar to FIG. 8 showing another form of centralizer.

Turning now to FIG. 9, there is shown another embodiment of the present invention wherein the tool is a centralizer having spiral blades. The centralizer, shown generally as 70, comprises an annular body 72 from which project a plurality of circumferentially spaced, spiral blades, 74. In the embodiment of FIG. 9, the sleeve shown generally as 80, and as in the case of the other embodiments of the present invention described above, is comprised of first and second sleeve sections which when placed in surrounding relationship to pipe section 14 essentially form a substantially complete encircling sleeve. Sleeve 80 has first and second threaded ends 82 and 84, respectively, and a recess 86 disposed between threaded ends 82 and 84. Disposed in recess 86 is a key 88, which can be of virtually any shape. It will be appreciated while only one key is shown, a plurality of keys could be employed if desired, the goal being to ensure that the centralizer 70 rotates with the sleeve 80 and hence the pipe 14. As seen, a portion of body 72 has an axially extending channel 90. When centralizer 70 is positioned on sleeve 80, such that recess 86 and channel 90 are in register there is found a keyway for receipt of key 88.

In assembling the embodiment of FIG. 9, prior to the tool joints or other end connections being welded onto pipe section 14, the sleeve sections forming sleeve 80 would be positioned over the OD of pipe section 14, following which centralizer 70 would be slid over one end, the orientation being such that the channel 90 will come in register with recess 86 and key 88. Following this, the collars 40 and 42 can be threaded onto the threaded ends 82 and 84 of sleeve 80 in the manner described above to mechanically and rigidly connect sleeve 80 and hence centralizer 70 to pipe section 14.

In the case where the centralizers, e.g., centralizers 50 and 70 are split, the split portions of the centralizer could be integrally formed with the sleeve section. Thus, there would be one sleeve section having substantially one half of the centralizer and other sleeve section having the other half of the centralizer. Accordingly, the centralizer could be changed in the field since there would be no necessity slide the centralizer over one end of the pipe 14 as is the case if the centralizer is of one-piece construction and is connected to the split sleeve sections either by key/keyway assembly such as shown in FIG. 9 or by interconnecting threads such as shown in FIG. 8.

Figure 13:
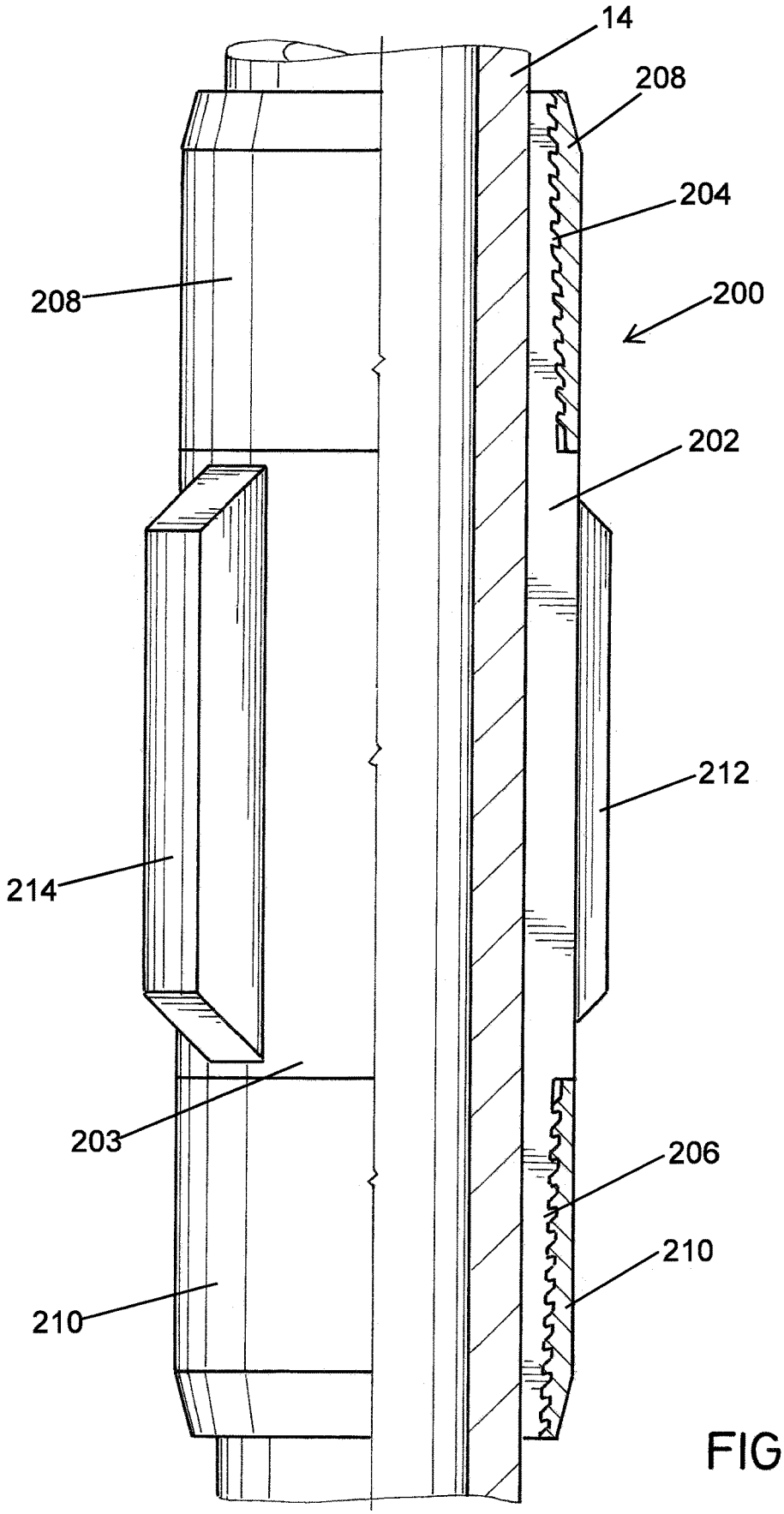
FIG. 13 is an elevational view, partly in section, showing another embodiment of the carrier assembly of the present invention.

Referring now to FIG. 13, there is shown an embodiment of the present invention wherein the tool is a centralizer of the split variety. The carrier assembly and tool, shown generally as 200, comprises first and second sleeve sections 202 and 203 as described above with respect to many of the embodiments. As in the case of the other embodiments, the sleeve section 202 has first and second threaded ends 204 and 206, it being understood that the other sleeve section 203 would have a like construction. Threadedly received on threaded ends 204 and 206 are collars 208 and 210, respectively. As in the embodiment of FIG. 8, the centralizer shown in assembly 200 has longitudinally extending ribs 212, two of the longitudinally extending ribs 212 being on sleeve section 202, the other two longitudinally extending ribs 214 being on sleeve section 203. As shown, the ribs 212, 214 are integrally formed with sleeve sections 202, 203, respectively. Indeed, the sleeve sections and the ribs are preferably a monolithic body.

Figure 10:
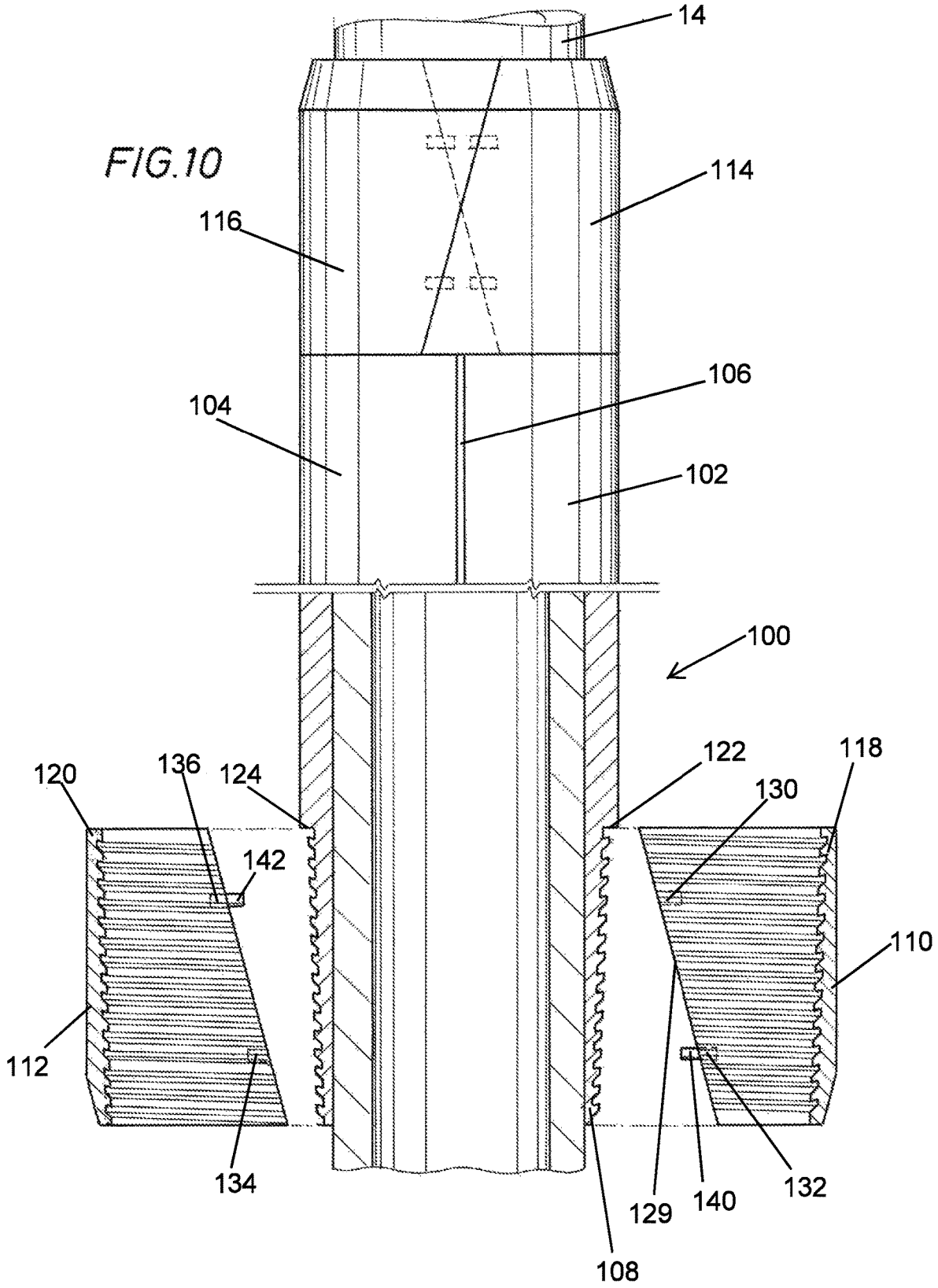
FIG. 10 is an elevational view, partly in section, showing another embodiment of the carrier assembly of the present invention.

Turning now to FIG. 10 there is shown yet another embodiment of the carrier of the present invention wherein the collars are also split. In FIG. 10, the carrier assembly shown generally as 100 comprises a sleeve having first and second sleeve sections 102 and 104 there being at least one gap 106 between the sleeve sections 102 and 104 when they are placed in surrounding relationship to pipe section 14. As in the previous described embodiments, the opposed ends of the sleeve sections 102 and 104 are threaded. While only one threaded end 108 will be described, it will be understood that the opposite end would have similar threads. In any event, threaded end 108 comprises hook threads or negative load flank threads well known to those skilled in the art. The collar sections 110 and 112 likewise have hook, or negative load flank threads, complementary to the threads on threaded end 108. Accordingly, when the threaded collar sections 110 and 112 are threaded onto threaded end 108, the engaged hook threads of collar sections 110 and 112 and threaded end 108 will prevent the collar sections 110 and 112 from radially separating from threaded end 108, particularly when the collar sections 110 and 112 are made-up on the threaded end 108 such that the end faces 118 and 120 of collar sections 110 and 112, respectively, are in abutting relationship with shoulders 122 and 124, i.e., are made-up to the desired torque.

It will be appreciated that when the tubular member(s) forming collar sections 110 and 112 and collar section 114 and 116 are split as shown in FIG. 10, there will be formed longitudinally extending, circumferentially facing surfaces such as surfaces 129 and 131 shown on collar sections 110 and 112, respectively. A pair of spaced dowel holes 130 and 132 are formed in surface 129. Collar section 112 likewise has similar dowel holes 134 and 136. It will be appreciated that when the collar sections 110 and 112 are mated together along the oblique splits, the dowel holes on collar sections 110 and 112 will be in register. Accordingly, for ease of assembly in the field, dowel pins such as dowel pins 140 and 142 can be used to hold the sections, e.g., sections 110 and 112 together whereby the collar formed of the respective collar sections can be easily threaded on to the threaded end, e.g., threaded end 108. As seen on the upper portion of FIG. 10, there are a total of eight dowel holes, four in each collar section and a total of four dowel pins. Fewer or more dowel holes/dowel pins can be employed.

Figures 11, 11A:
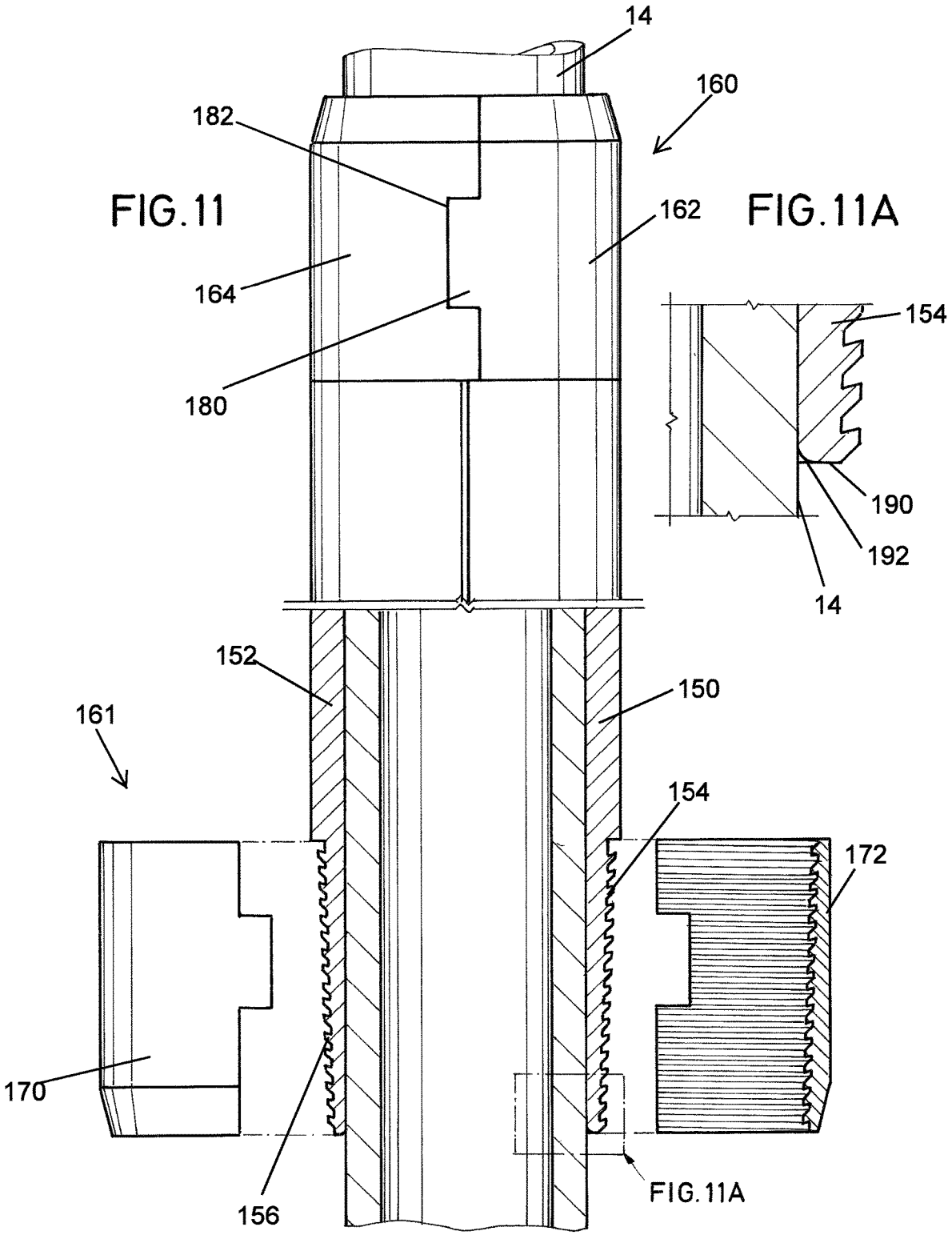
FIG. 11 is an elevational view, partly in section, showing another embodiment of the carrier assembly of the present invention.
FIG. 11A is an enlarged view of a portion of the carrier assembly shown in FIG. 11.

Turning now to FIGS. 11 and 11A, there is shown another embodiment of the carrier of the present invention wherein the collars are split. As in the previous embodiments, there is a sleeve having first and second sleeve sections 150 and 152 having threaded ends 154 and 156, respectively. It will also be appreciated that the opposite ends of the sleeve sections 150 and 152 are likewise threaded as described above with respect to the other embodiments. Received on the threaded ends of the sleeve formed by the respective sleeve sections 150 and 152 are collars shown generally as 160 and 161, collar 161 being shown in an exploded view. Collar 160 comprises first and second collar sections 162 and 164. Collar sections 170 and 172 are threadedly received on the threads 154 and 156 of sections 150 and 152, respectively.

Collar 160, as well as the collar 161 formed by collar sections 170 and 172, is split longitudinally, the split providing formations that are projecting as to one and receiving as to the other. Thus, with reference to collar 160, collar section 162 would have two circumferentially projecting tongue portions 180 while collar section 164 would have two circumferentially facing grooves 182, complementary in shape to tongues 180. Thus, to connect collar 160 to the sleeve formed by sleeve sections 150 and 152, collar sections 162 and 164 would be mated such that the tongue formations 180 were received in the grooves 182. The thus formed collar 160 could be threaded onto the sleeve formed by the sleeve sections 150 and 152 and the projecting and receiving formations 180 and 182, respectively, together with the hook threads would prevent the collar 160 from separating radially or axially from the assembly. In other words, once collar 160 was made-up to the desired torque level, the engaged hook threads on the collar and on the sleeve would prevent any radial separation while the interengaged projecting and receiving formations, e.g., tongues 180 and grooves 182, would preclude any relative axial movement between collar sections 162 and 164.

FIG. 11A is an enlargement of the portion of FIG. 11 shown in the dotted rectangle. As seen in FIG. 11A, the threaded end 154 of sleeve section 150 terminates in a substantially semi-circular, axially facing surface 190. It is preferred that the innermost edge of surface 190 be radiused as shown at 192. As will be understood, these radiused edges would be on all end surfaces of the sleeve sections making up the carrier sleeves of the present invention. As will be appreciated, when the carrier assemblies of the present invention are connected to various joints of pipe in a pipe string, e.g., drilling string, casing string, or the like, the strings are subjected to various forces. Thus, at any given time in a downhole operation, the strings can be rotating, and/or moving longitudinally through the borehole, or moving from the vertical run of a borehole to a horizontal or other lateral borehole portion, resulting in the string being subjected to various forces such as torsional loading, cyclic tension and compression loading, and the like. Recognizing these various forces acting on the string it has been found that, by radiusing the edges of the surfaces to form a radiused surface 192, fretting of the pipe section 14 is greatly reduced.

Non-limiting examples of "tools" that can form part of and/or be attached to the carrier of the present invention include centralizers, stabilizers, non-rotating drill pipe protectors, wear sleeves or bands, non-rotating drill pipe casing protectors, non-rotating centralizers, non-rotating stabilizers, drill string torque reducers, etc. Indeed, the outer surfaces of the sleeve sections making up the sleeve can have hard facing or can be treated in a particular fashion so as to perform a useful function in a downhole operation and/or prevent an undesirable action from occurring in a downhole operation. As evidenced from the above, the tools, whatever their nature can comprise annular bodies which slip over the sleeve sections or can be in turn split sections which are formed integral with the sleeve sections and/or connected to the sleeve sections.

Although specific embodiments of the invention have been described herein in some detail, this has been done solely for the purposes of explaining the various aspects of the invention, and is not intended to limit the scope of the invention as defined in the claims which follow. Those skilled in the art will understand that the embodiment shown and described is exemplary, and various other substitutions, alterations and modifications, including but not limited to those design alternatives specifically discussed herein, may be made in the practice of the invention without departing from its scope.

What is claimed is:

1. A carrier for connecting a tool to the outside diameter (OD) of a tubular member, comprising:

an elongate sleeve having a first end, a second end and first and second externally threaded end portions, said sleeve comprising an elongate body comprising a first sleeve section and a second sleeve section, said first sleeve section having a first substantially semi-circular wall forming first and second longitudinally extending surfaces, said second sleeve section having a second substantially semi-circular wall forming third and fourth longitudinally extending surfaces, said first and second ends being fixed against relative axial movement;

a first internally threaded collar threadedly receivable on said first threaded end portion of said sleeve;

a second internally threaded collar threadedly receivable on said second threaded end portion of said sleeve; and wherein when said first and second collars are threadably received on said first and second threaded ends, respectively, said first and second sleeve sections are compressed radially inwardly into engagement with said tubular member to mechanically and rigidly connect said sleeve to said tubular member and prevent relative rotation of said sleeve and said tubular member.

2. The carrier of claim 1, wherein said body comprises a larger diameter portion, a first smaller diameter portion, a first annular axially facing shoulder being formed between said larger diameter portion and said first smaller diameter portion and a second smaller diameter portion, a second annular axially facing shoulder being formed between said second smaller diameter portion and said larger diameter portion, said first threaded end portion being formed on said first smaller diameter portion, said second threaded end portion being formed on said second smaller diameter portion.

3. The carrier of claim 2, wherein said first collar has a first face and said second collar has a second face wherein, said first face abuts said first shoulder and said second face abuts said second shoulder in said made up position, whereby said collar can be torqued up to a desired value by engagement of said collar faces with said shoulders.

4. The carrier of claim 1, wherein there is a first gap between said first and third surfaces and a second gap between said second and fourth surfaces.

5. The carrier of claim 4, wherein said gap is from 0.020 to about 0.060 inches.

6. The carrier of claim 1, wherein said first sleeve section has a first end and a second end, and there is a first axially extending slit extending from said first end of said first sleeve section, and a second axially extending slit extending from said second end of said first sleeve section, and said second sleeve section has a third end and a fourth end, and there is a third axially extending slit extending from said third end of said second sleeve section, and a fourth axially extending slit extending from said fourth end of said second sleeve section, whereby said sleeve sections are compressed radially inwardly so as to tightly grip said tubular member when said first and second collars are received on said first and second threaded end portions, respectively.

7. The carrier of claim 6, wherein said first and second slits extend to points intermediate said first and second ends of said first sleeve section, and said third and fourth slits extend to points intermediate said third and fourth ends of said second sleeve section.

8. The carrier of claim 7, wherein each of said slits terminates in a respective stress relieving opening through said sleeve sections.

9. The carrier of claim 1, wherein said first and second sleeve sections have first and second inner wall surfaces, respectively, and there is double-sided adhesive material adhered to at least a portion of at least one of said first and second wall surfaces.

10. The carrier of claim 9, wherein said double-sided adhesive material is adhered to both of said first and second inner wall surfaces.

11. The carrier of claim 1, wherein said first collar comprises first and second collar segments and first and second collar faces, said first and second collar segments being formed by first and second splits through said collar extending from said first face to said second face, and said second collar comprises third and fourth collar segments and third and fourth collar faces, said third and fourth collar segments being formed by third and fourth splits through said collar extending from said third face to said fourth face.

12. The carrier of claim 11, wherein said first and second splits are oblique to said first and second faces.

13. The carrier of claim 11, wherein said third and fourth splits are oblique to said third and fourth faces.

14. The carrier of claim 11, wherein said first and second splits form surfaces on said first and second segments which are projecting as to one and receiving as to the other.

15. The carrier of claim 11, wherein said third and fourth splits form surfaces on said third and fourth segments which are projecting as to one and receiving as to the other.

16. The carrier of claim 11, wherein there is a tool mounted on said carrier.

17. The carrier of claim 16, wherein said tool comprises a centralizer.

18. The carrier of claim 17, wherein said centralizer comprises at least three circumferentially spaced, axially extending blades.

19. The carrier of claim 17, wherein said centralizer comprises at least three circumferentially spaced, spiral blades.

20. The carrier of claim 19, wherein said centralizer comprises a first centralizer portion carried on said first sleeve section and a second centralizer portion carried on said second sleeve section.

21. The carrier of claim 20, wherein the blades of said centralizer are integrally formed with said sleeve sections.

22. The carrier of claim 11, wherein said tool comprises hard surfacing.

23. The carrier of claim 22, wherein said hard surfacing comprises at least one wear band.

24. The carrier of claim 11, wherein said first and second threaded end portions comprise hook threads and said threads on said first and second collars are mating hook threads.

25. The carrier of claim 11, wherein said threads on said first threaded end and said threads on said first collar have a first thread form preventing said first and second collar segments from radially separating; and said threads on said second threaded end and said threads on said second collar have a second thread form preventing said third and fourth collar segments from radially separating.

26. The carrier of claim 25, wherein said first and second thread forms are negative flank threads.

27. A carrier for connecting a tool to the outside diameter (OD) of a tubular member, comprising:

an elongate sleeve having a first end, a second end and first and second externally threaded end portions, said sleeve comprising an elongate body comprising a first sleeve section and a second sleeve section, said first sleeve section having a first substantially semi-circular wall extending from said first threaded end to said second threaded end and forming first and second longitudinally extending surfaces, said second sleeve section having a second substantially semi-circular wall extending from said first threaded end to said second threaded end and forming third and fourth longitudinally extending surfaces, said first and second ends being fixed against relative axial movement, said first and second sleeve sections being free of any connectors extending from any of said first, second, third, or fourth longitudinally extending surfaces to connect said first sleeve section to said second sleeve section;

a first internally threaded collar threadedly receivable on said first threaded end portion of said sleeve;

a second internally threaded collar threadedly receivable on said second threaded end portion of said sleeve;

said first and second collars being threadedly tightened on said threaded ends; and wherein when said first and second collars are threadably received on said first and second threaded ends, respectively, said first and second sleeve sections are compressed radially inwardly into engagement with said tubular member to mechanically and rigidly connect said sleeve to said tubular member and prevent relative rotation of said sleeve and said tubular member.

* * * * *